US005507363A

United States Patent [19]

Tredup

[11] Patent Number: 5,507,363

[45] Date of Patent: Apr. 16, 1996

[54] UNIVERSALLY ADJUSTABLE SUPPORT PLATFORM FOR LADDERS

[75] Inventor: Richard A. Tredup, 222 Ford St., Geneva, Ill. 60134

[73] Assignee: Richard A. Tredup, Geneva, Ill.

[21] Appl. No.: 401,041

[22] Filed: Mar. 8, 1995

Related U.S. Application Data

[62] Division of Ser. No. 278,327, Jul. 21, 1994, Pat. No. 5,431,249.

[51] Int. Cl.[6] ..... E06C 7/14

[52] U.S. Cl. ..... 182/129; 182/122; 248/210

[58] Field of Search ..... 182/129, 121, 182/122, 206; 248/210, 211, 238

[56] References Cited

U.S. PATENT DOCUMENTS

| | | | |
|---|---|---|---|
| 1,221,658 | 4/1917 | Berry | 248/210 |
| 1,257,056 | 2/1918 | Wheatley | 248/238 |
| 2,578,862 | 12/1951 | Tims | 182/121 X |
| 2,838,342 | 6/1958 | Masse | 248/238 |
| 3,332,653 | 7/1967 | Hoelzel | 248/210 |
| 3,822,846 | 7/1974 | Jesionowski | 248/210 |
| 4,515,242 | 5/1985 | La Chance | 248/238 X |
| 4,560,127 | 12/1985 | Ippolito | 248/210 |
| 4,646,878 | 3/1987 | Moyer | 248/238 X |
| 5,079,795 | 1/1992 | Schmid | 248/238 X |
| 5,276,943 | 1/1994 | Ludy | 248/211 X |

*Primary Examiner*—Alvin C. Chin-Shue
*Attorney, Agent, or Firm*—Hill, Steadman & Simpson

[57] ABSTRACT

A universal portable support platform for a ladder base is formed from a plurality of interfitting elements capable of left and right interconnections so that a horizontal support can be located selectively adjacent an elevated work site. Adjustment means are provided to level the horizontal support, regardless of the angulation of the ladder base.

1 Claim, 4 Drawing Sheets

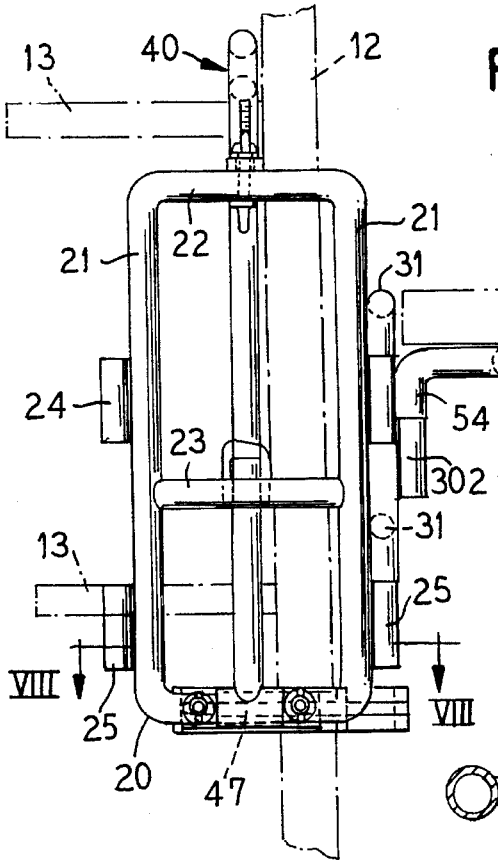
FIG. 7
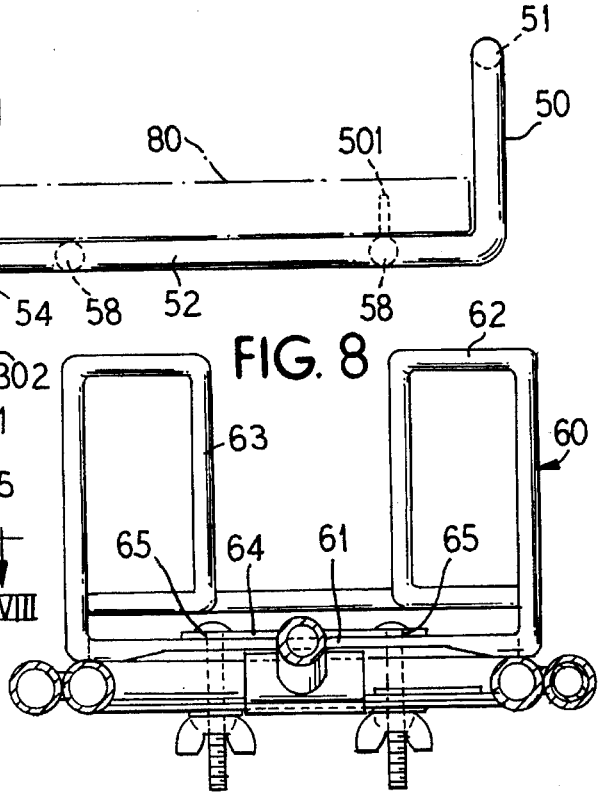
FIG. 8
FIG. 9
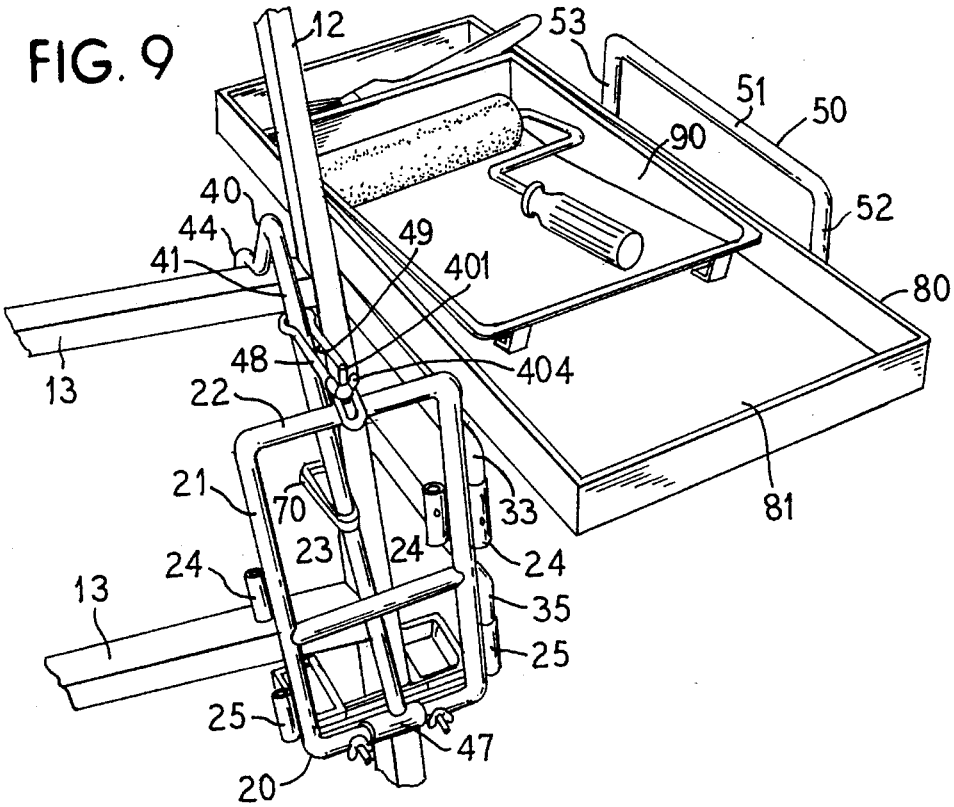

UNIVERSALLY ADJUSTABLE SUPPORT PLATFORM FOR LADDERS

This is a division of application Ser. No. 08/278,327, filed Jul. 21, 1994, U.S. Pat. No. 5,431,249, issued Jul. 11, 1995.

BACKGROUND OF THE INVENTION

1. Field of the Invention

This invention relates to a support platform to be attached to a ladder and by means of which the user may have access to a variety of articles and/or containers carried on the platform, in conducting work tasks while mounted on the ladder.

2. Description of the Prior Art

Work tasks are frequently performed while mounted on a ladder designed to place the user at an elevated position above a support surface, such as ground level. However, the user, or worker, while so mounted may require access to a variety of tools and/or containers. For example, if the task relates to painting, the user may want to have within easy access one or more paint brushes, sometimes of more than one size, and the user may also desire access to a can of paint or a paint tray for use with a brush applicator, as well as wiping cloths, scrapers and possibly other tools and appliances.

Other work tasks may require that the worker have access to various tools of different descriptions as may be used in construction and repair. Generally, such needs are satisfied by the improvisational use of hooks and other suspension devices by means of which the articles are suspended from one of the rungs or steps of the ladder. With such jury rigged arrangements, access to the tools is limited and convenience is lost.

Further, if the prior art devices are designed for rung-type ladders, they cannot be effectively used with ladders of the slat-type steps, and vice versa. Again, different ladders fold out to different degrees of angulation, and if the prior art device is of a suspension type, it may not hang properly and is thus incapable of properly supporting the article for maximum utilization by the worker.

Prior art hook devices are also incapable of providing a flat platform surface for the proper support of utilitarian articles. If, perchance, something resembling a flat surface is provided, it may not be disposed in a horizontal plane, and is incapable of proper adjustment for optimum placement adjacent the work site.

Some ladders are provided with a utility platform at the level of the top rung or top step of the ladder. When the legs are folded out, the platform is folded down and is permanently locked in place. It cannot be moved laterally or vertically and is generally of a limited size dictated by the spacing dimension between the legs and the rungs of the ladder.

SUMMARY OF THE INVENTION

The present invention contemplates the construction of a support which is universally applicable to all types of ladder constructions. Moreover, the support of the present invention is selectively mounted on the base at any desired height and is provided with separate modalities for adjusting the support relative to the angulation of the ladder, and also to adjust the relative planar alignment of the support, so that it can be levelled on a horizontal plane. Means are provided to effectively carry the support on a ladder with cylindrical rungs as well as on a ladder with flat slat-like steps.

Additionally, the support is adaptable to either a left or a right orientation, thereby enabling the user to mount the platform on either lateral side of a ladder. Multiple support arms are utilized so that the support surface enjoys great stability and is strong enough to bear a considerable load and/or to provide an extensive support surface capable of carrying a relatively heavy load safely and securely.

BRIEF DESCRIPTION OF THE DRAWINGS

FIG. 7 is a front elevational view of the support platform of the present invention, with parts of a ladder shown in phantom, for establishing relative orientation of the parts.

FIG. 8 is a fragmentary cross-sectional view taken on line VIII—VIII of FIG. 7.

FIG. 9 is an upper perspective view of the support platform of the present invention with a tool box in place and with a paint tray in the tool box.

DESCRIPTION OF THE PREFERRED EMBODIMENTS

While a ladder is illustrated as the base for carrying the support platform of the present invention, it should be understood that the term, "ladder" is used in this specification generically to refer to any kind of a base foundation element that is used to elevate a worker to a point of utilization which is at a higher elevation. Thus, as used herein, the term "ladder" is intended to describe and to apply to ordinary household ladders, both rung-type, and step-type, and to extension ladders, as used professionally by painters and decorators, by roofers and other construction tradesmen, and to temporary or permanent scaffolding erected for the purpose of affording access to an elevated work site.

Figure 1:
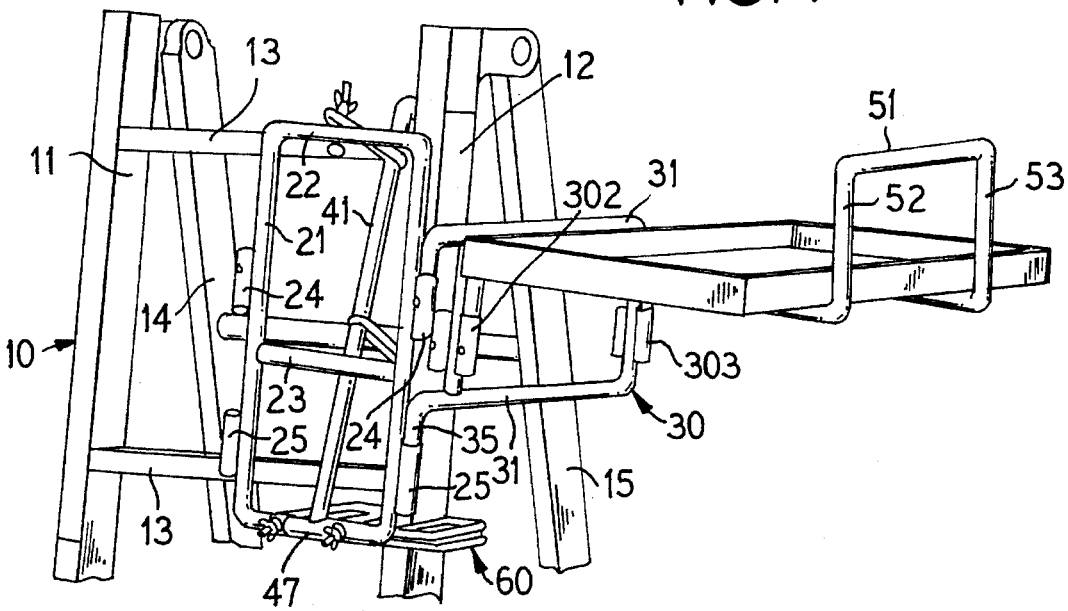
FIG. 1 is a perspective view of a support platform provided in accordance with the principles of the present invention, disposed in a right hand mount, using the orientation of the drawing, and the support is illustrated in association with a conventional commercially available ladder depicted in a fragmentary manner and constituting a ladder of the type having flat slat-type steps.

Referring to FIG. 1 of the drawings, there is illustrated one exemplary form of application of the support of the present invention wherein the ladder is shown by way of example, but not by way of limitation, as constituting a base 10 and having two spaced apart legs 11 and 12 between which legs are extended and interconnected a plurality of longitudinally spaced steps 13. In the exemplification of this form of base 10, the individual steps 13 are flat slat-like steps that are connected or integrated at opposite ends to the legs 11 and 12 in firm assembly therewith, and by means of which a user or worker may climb to work site at an elevated location.

To steady the ladder, a corresponding pair of rearwardly disposed legs 14 and 15 are pivotally connected at or near the top of the legs 11 and 12 by means of an appropriately constructed pivot bracket 16. The ladder 10 is utilized by spreading the bottom ends of the legs 11, 12, 14 and 15 to engage the ground, or the support surface, not shown, thereby permitting the ladder 10 to be virtually self-sustaining in an upright, erected position. With other forms of ladders, such as an extension ladder, the legs would be leaned against an architectural structure, such as a house or building, for example, so that the upper end would be engaged against the building and the lower end would be engaged with the ground.

Figure 2:
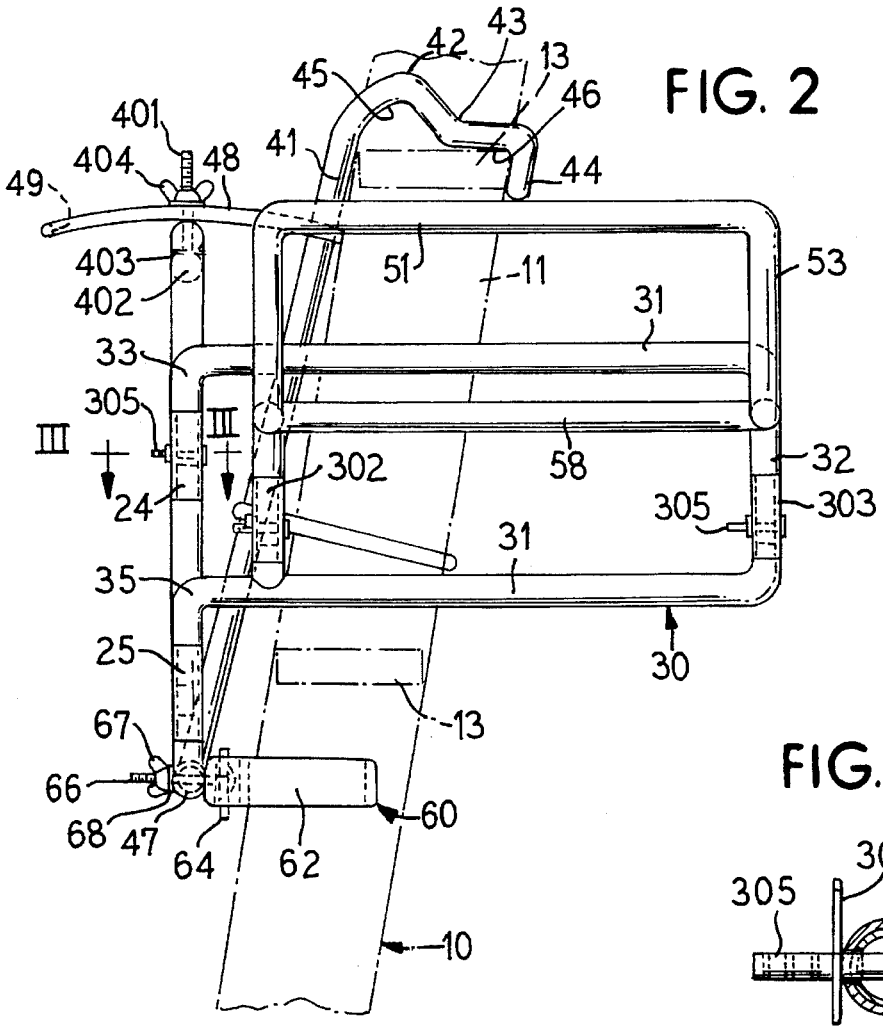
FIG. 2 is a side elevational view of the support platform of FIG. 1, but with parts of the ladder shown in phantom lines, and disclosing additional details of the invention.
Figure 3:
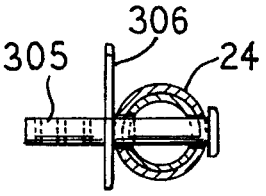
FIG. 3 is a fragmentary cross-sectional view taken on line III—III of FIG. 2.
Figure 4:
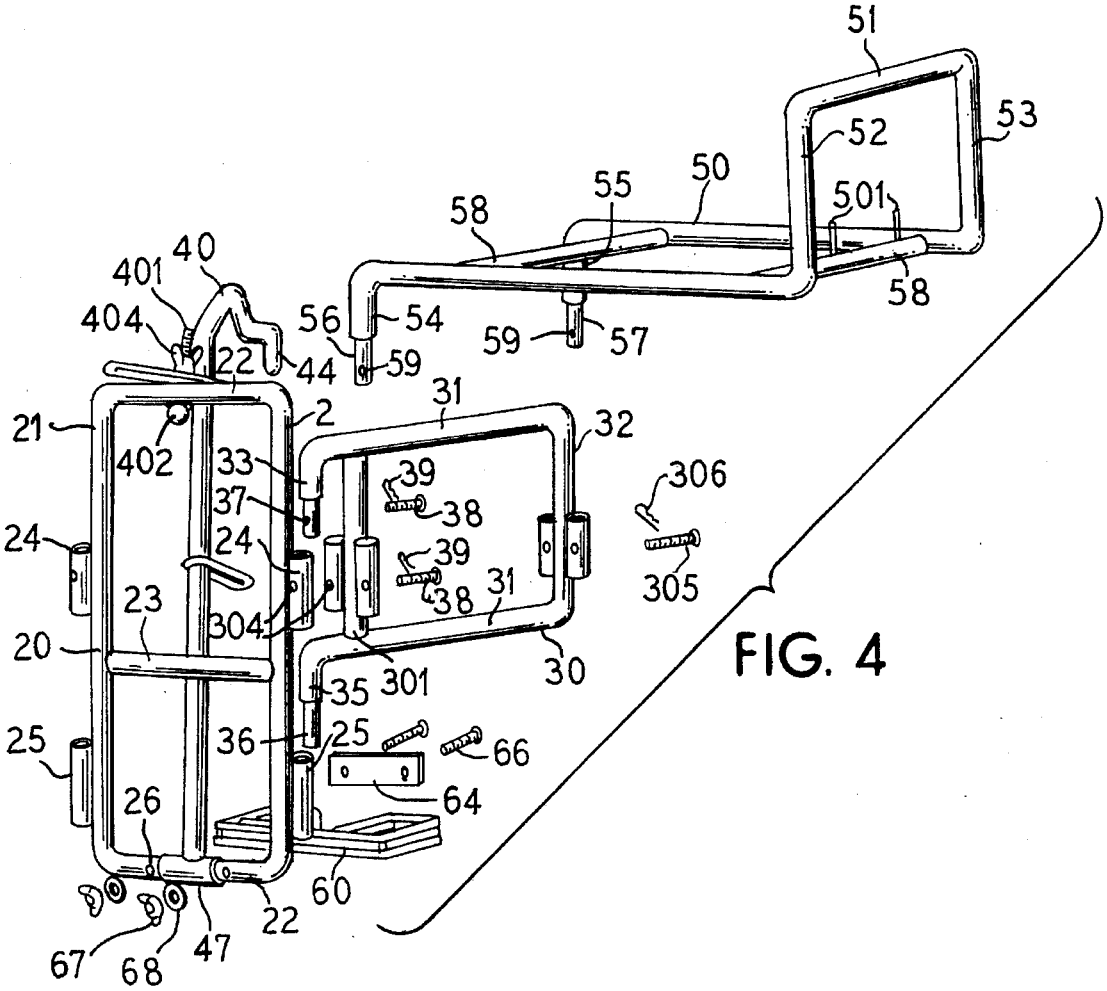
FIG. 4 is an exploded view of the support platform with the parts and components separated from one another, but aligned to show the details of construction and the mode of cooperation between the parts and components.
Figure 5:
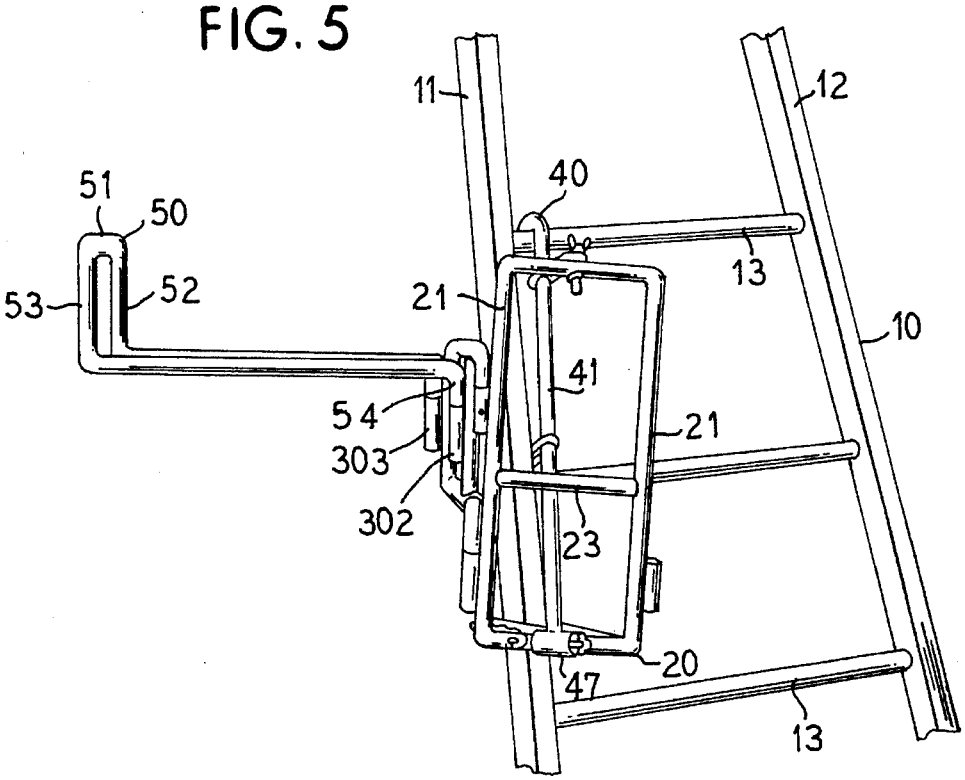
FIG. 5 is a view of the support platform of the present invention disposed in a left hand mount, and the support is shown in association with a conventional commercially available ladder of the type wherein rungs are provided on the ladder which are of generally cylindrical configuration.

In accordance with this invention, a portable support platform 20 is selectively attached to the base 10 for the purpose of creating a utilitarian platform support in an accessible location adjacent an elevated work site. The portable support platform comprises four fundamental components which may be conveniently identified by referring to the exploded view of FIG. 4 in conjunction with the assembled view of FIGS. 1 and 2.

The parts thus referred to are constituted by a front support frame 20, a side support frame 30, a suspension support member 40, and a horizontal platform support 50.

The front support frame 20 more specifically comprises a generally rectangular member which, in the illustrated form of the invention, takes the structural form of a cylindrical tube shaped member bent and formed to provide a pair of spaced parallel longitudinal legs each identified at 21 and spaced parallel end legs identified at 22. In order to give strength and rigidity to the sub-assembly, one or more cross-legs 23 may be provided intermediate the end legs 22.

Upper bracket lugs 24 are connected in firm assembly to each of the longitudinal legs 21 and are spaced vertically above a corresponding pair of lower bracket lugs 25 which are likewise connected in firm assembly to each of the longitudinal legs 21. The lugs 24 and 25 may be conveniently provided by the use of small pipe segments or of a generally cylindrical metal-form member. In accordance with this invention, the inner diameter of the through holes centrally disposed on the axis of each lug is different for the two top lugs 24 than it is for the two lower lugs 25, a structural feature that permits the lugs to cooperate in a piloting relationship with mating parts inserted therein, as will be evident from the disclosure of further coupling means, of which the bracket lugs are a component, as this description proceeds. The upper lugs 24 are also each provided with a transverse aperture 26 to receive a locking member such as a screw or a cotter key.

The side support frame 30 comprises a member which is also shaped and formed from tubular or cylindrical bar stock into the configuration of a rectangle having spaced upper and lower parallel legs 31 joined to one another at one end thereof by an end leg 32. At the opposite end, the upper leg 31 is formed with an inwardly offset arm 33 which has a pivot pin 34 depending therefrom. If the side frame 30 is formed as a solid cylinder, the pin 34 may be machined thereon, or if the side frame 30 is a tube, the pin 34 may be inserted and firmly assembled or otherwise fixed into the end of the arm 33. The diameter of the pin 34 is selected to be complemental to the inner diameter of the upper lugs 24 on the front frame, thereby forming together therewith a coupling means and accomplishing a mating relationship when fitted together.

The opposite end of the lower leg 31 is similarly offset, but outwardly and downwardly to form an arm 35, which in the same manner as with the arm 33, is provided with a pivot pin 36. The outer diameter of the pin 36 is of a different dimensional diameter than that of the pin 34, but it is complemental with the inner diameter of the lower lugs 25 on the front frame 20. Thus, the pins 34 and 36 mate with the lugs 24 and 25 as a coupling joint so that the side frame can be installed either on the left side or the right side, selectively, depending on which of the longitudinal legs 21 is most conveniently located. Furthermore, because of the difference in the diameters of the pins 34 and 36 and the receiving sockets provided by the lugs 24 and 25, a piloting function is developed since the user must correctly position the side frame 30 relative to the front frame 20 in order to achieve assembly and obviating the possibility of a misassembly of the parts.

The upper pin 34 is apertured as at 37 and at a location so that it is in full registration with the corresponding aperture in the upper lug 24. Thus, a locking element or anchoring member such as a screw 38 and wing nut 39 may be inserted through the parts and securely locked in place.

The side frame 30 is also provided inwardly of the end opposite the end leg 32 with a cross-leg 301 extending between the upper and lower legs 31 and disposed in parallel spaced relation relative to the end leg 32. A pair of mounting lugs is attached to the cross-leg 301 as at 302 and to the end leg 32 as at 303. As before the mounting lugs 302 and 303 may be conveniently formed as pipe segments or cylindrical tube segments and are firmly attached, as by welding or the like, to opposite sides of the legs on which they are carried, in order to afford a "right" or "left" mounting selection, since they form sockets for receiving corresponding fittings of the horizontal frame 50.

In order to afford a locked together relation, the lugs 302 and 303 are apertured as at 304 thereby to receive a screw 305 and cooperating with a wing nut 306.

The suspension support member 40 is comprised of an elongated cylindrical metal form such as a rod or a tube. The upper end of the member 40, using the orientation of the drawings, is formed and shaped in a unique manner to accommodate securement of the member 40 to either a step or to a rung of a ladder. Thus, the member 40 has a main elongated body portion 41 which curves gradually to an apical extremity 42, at which point the member 40 is shaped to describe an acute angle, thereby extending downwardly and laterally so that there is formed a hook 43 with a downwardly turned flange 44 at its free end.

Figure 6:
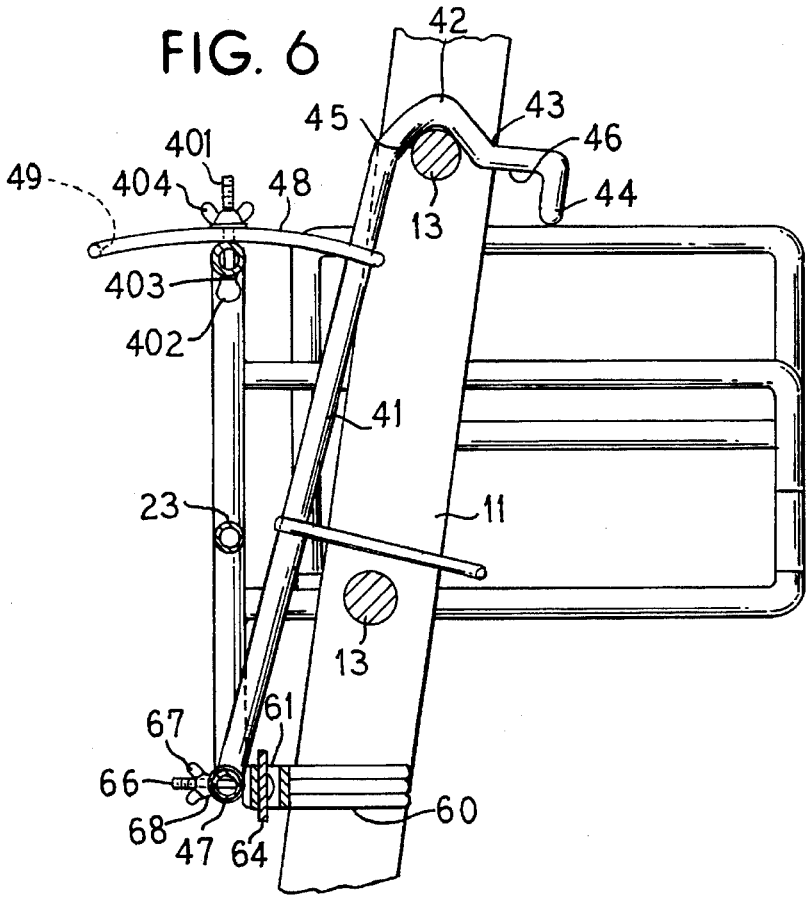
FIG. 6 is a cross-sectional view with parts shown in side elevation and taken essentially on the plane of line VI—VI of FIG. 5.

By virtue of such configuration, the inside of the hook 43 prescribes a recess 45 opposite the extremity 42 which is ideally suited to embrace the rung of a runged ladder, as depicted in FIG. 6. There is also provided an extended flat surface 46 which is ideally suited to engage the top surface of a step on a step-type ladder. In such usage, the flange 44 engages over the edge of the step and insures that the hook 43 is tightly engaged with the step 13 (FIG. 1).

The elongated body portion 41 of the suspension support 40 is of sufficient length to extend in a generally vertical direction from the top to the bottom of the front support frame 20 and terminates at its lowermost end in a cross-piece 47 fastened to the end thereof to form a T-shaped tube in which is telescopically received the lower end leg 22 of the front support 20. The two parts, 20 and 40, are thus pivotally connected to one another, thereby affording relative angular adjustment between them.

In order to provide and accommodate such angular adjustment, there is provided a curved guide member 48 which is longitudinally slotted as at 49 (FIG. 9) and which guide member is fixedly connected at one end to the upper portion of the body member 41. A screw 401 has an enlarged seating head 402 is seated on a washer 403 and passes through the upper cross-leg 22 for cooperation with the slot 49 in the curved guide member 48. An adjustable wing nut 404 turns on the screw 401, thereby locking the suspension support 40 in any selected position of angular adjustment relative to the front support 20.

To further stabilize the engagement of the front support 20 on the base, the lower cross-leg 22 is provided with two apertures 26, one on each side of the cross-piece 47. A generally U-shaped bracket or stabilizer 60 has a bight portion 61 and two parallel spaced apart legs 62 and 63 extending away therefrom. An elongated washer 64 has two apertures 65 formed therein in the same spacing relationship as the apertures 26 so that the stabilizer 60 can be connected in firm assembly with the front support 20 by means of a pair of screws 66 which pass through the apertures 65 in the washer 64, through the bight portion 61 of the stabilizer 60 through the apertures 26 in the lower leg 22 of the front support 20 for engagement with a pair of wing nuts 67 each seated on a washer 68. When so assembled, it will be appreciated that the stabilizer bracket 60 may be disposed to embrace the leg 11 or the leg 12 of the ladder 10, with one leg 62 on one side and the other leg 63 on the other side, thereby inhibiting lateral displacement. A supplemental restraining guide 70 may be provided, if desired along an intermediate portion of the elongated body 41 on the suspension support 40 and will likewise engage one or the other of the ladder legs adjacent thereto.

The horizontal platform support 50 is a part made of cylindrical stock bent and shaped to provide a first cross-leg 51 and with an elongated body leg 52 and 53 extending therefrom in spaced apart parallel relation to one another. At a suitable distance spaced from the cross-leg 51, preferably a distance selected to provide a vertical retainer for the platform (see FIG. 4), each of the body legs 52 and 53 is offset at a right angle, thereby to form a horizontal support leg. Both of the body legs then terminate in a second offset leg depending at right angles and identified at 54 and 55.

A pin 56 is provided at the free end of the leg 54 and a pin 57 is provided at the free end of the leg 55. Each of the pins 56 and 57 are cylindrical and have outside diameters adapted to be complemental to the inner diameters of the lugs 302 and 303 on the side support 30. By means of such provision, the horizontal platform support 50 may be selectively assembled on the side support 30 simply by inserting the pins into the lugs 302 and 303 either for a left side mount or for a right side mount.

In order to reinforce and strengthen the horizontal platform support, two cross-pieces 58 are connected to extend between the horizontal portions of the elongated body legs 52 and 53. The cross-pieces 58 are preferably disposed at a common level with the horizontal portions of the body legs 52 and 53, thereby to supplement and augment the horizontal support provided thereby.

The pins 56 and 57 are apertured as at 59, thereby to cooperate with the locking means in the form of the screws 305 and the wing nuts 306. Thus, the parts can be secured and locked in assembled position.

If desired, one or the other of the cross-pieces 58 may be provided with upstanding pin means such as the pins 501 to advantageously cooperate with a correspondingly recessed box or tray to be carried on the horizontal platform support 50. The interengagement of the pins 501 and mating recesses will prevent inadvertent displacement of the tray or box so placed.

In any event, the horizontal platform support 50 provides a utilitarian support for a variety of articles, including a box, such as the box 80 shown in some of the figures of the drawings or for a paint tray such as that shown at 90 in FIG. 8. The box shown in FIG. 9 is identified at 81 and has a special compartment for auxiliaries such as tools and paint brushes, and the box 81 may include the pins 501 for cooperation with the paint tray 90, if so desired. Because of the sturdy construction of the support platform provided herein, it will be understood that comparatively heavy loads may be carried and supported by the platform support 50 with safety and convenience.

In use, should the platform surface afforded by the support 50 be canted, or tilted away from horizontal, the suspension support 40 may be adjusted forwardly and backwardly to level the surface and locked in adjusted position by the wing nut 404.

Although minor modifications might be suggested by those versed in the art, it should be understood that I wish to embody within the scope of the patent warranted hereon all such modifications as reasonably and properly come within the scope of my contribution to the art.

I claim as my invention:

1. In a platform support for use with a ladder base, the improvement of a suspension support comprising:

an elongated first member having at one end thereof a hook-shaped end comprising an angled extremity forming an apical extremity having an acute angle and wherein the interior side of the angle forms a recess of reduced diameter size to accommodate a good fit with the cylindrical rung of a rung-type ladder, and said hook-shaped further including at the end of a horizontal leg portion a vertical leg portion offset downwardly at a right angle, thereby to insure that the hook-shaped end is firmly retained in assembly with the ladder, and further characterized by the opposite end of said first member of said suspension support having a T-shaped cross-piece, and a support means connected to said T-shaped cross piece in pivotal relationship so that the said first member of said support may be pivotally adjusted through a finite angle of adjustment relative to the support means, and an adjustment means between an upper portion of said support means and an adjacent portion of said first member, said adjustment means comprising a curved bracket fastened to said first member and having an elongated slot formed therein extending through the angle of adjustment towards the support means, and locking means extending through the slot and connected to the support means, whereby the first member may be secured in selected adjusted angular positions relative to the support means in order to compensate for different angulation alignments of the ladder base, said support means comprising a generally rectangular member having a cylindrical tube-shaped part bent and formed to provide a pair of spaced parallel longitudinal legs and spaced parallel end legs, said longitudinal legs having bracket lug means connected thereto for supporting and carrying additional support members.

* * * * *